United States Patent [19]

Way et al.

[11] 3,938,124

[45] Feb. 10, 1976

[54] ALARM SYSTEM SENSING DEVICE

[75] Inventors: Blaine A. Way, Schenectady; William R. Scholtz, Scotia, both of N.Y.

[73] Assignee: Salient Electronics, Inc., Schenectady, N.Y.

[22] Filed: May 23, 1974

[21] Appl. No.: 472,615

Related U.S. Application Data

[63] Continuation-in-part of Ser. No. 159,697, July 6, 1971.

[52] U.S. Cl. ..... 340/280; 340/240

[51] Int. Cl.[2] ..... G08B 21/00

[58] Field of Search ..... 340/240, 280

[56] References Cited

UNITED STATES PATENTS

| | | | |
|---|---|---|---|
| 342,709 | 5/1886 | Ruenzi | 340/240 |
| 883,335 | 3/1908 | O'Conner | 340/280 |
| 2,927,311 | 3/1960 | Donaldson | 340/280 |
| 2,972,132 | 2/1961 | Putney | 340/240 |
| 3,193,819 | 7/1965 | Magner | 340/280 |
| 3,253,270 | 5/1966 | Downer | 340/280 |
| 3,596,265 | 7/1971 | Garland | 340/280 |
| 3,753,257 | 8/1973 | Arnold | 340/240 |

*Primary Examiner*—Thomas B. Habecker
*Attorney, Agent, or Firm*—Kane, Dalsimer, Kane, Sullivan and Kurucz

[57] ABSTRACT

An alarm sensor device of two major portions. The first portion is a securely enclosed chamber containing one or more connector elements and the second portion is a specific length of cable having conductor paths for energy transmission and having at least one connector device attached to at least one free end of the cable with the connector being compatible with the connector element installed within the enclosed chamber. Separate and additional means for interconnection of the conductors within the chamber to conductors of energy originating from alarm system equipment at a remote location is also provided. The specific length of cable securely emanates from and thereafter terminates by connector means within the enclosed chamber thereby forming a closed loop of fixed and unalterable circumference thereby providing a loop to protectively encircle an object. Any attempt to enlarge the fixed circumference of the closed loop of cable for the purpose of removing it from the object will cause an alteration of the pattern of energy flowing within the cables thereby causing a remote detection of attempted theft and allowing the activation of an alarm signal warning system.

3 Claims, 10 Drawing Figures

FIG. 1
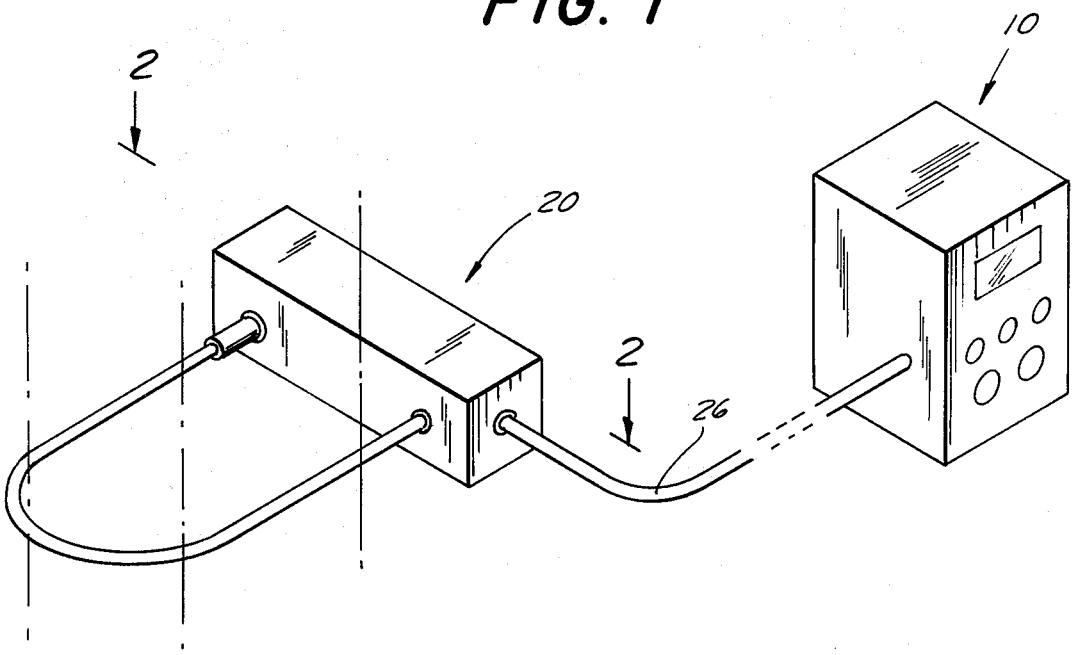
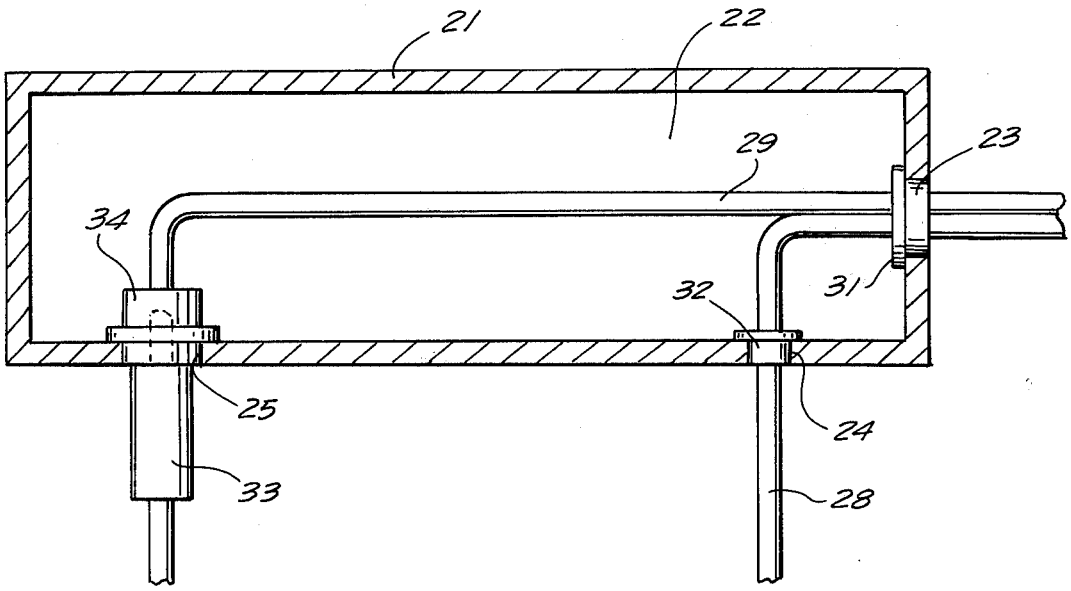
FIG. 2

ALARM SYSTEM SENSING DEVICE

CROSS REFERENCE TO RELATED APPLICATIONS

This application is a continuation-in-part of application Ser. No. 159,697, filed July 6, 1971.

BACKGROUND OF THE INVENTION

It is often desirable to provide an anti-theft alarm system for preventing unauthorized removal of an otherwise movable object from a specific physical location.

There are many varieties of burglar alarms, theft alarms, and protective alarm systems which serve to protect objects of private property by physically connecting to the object which requires protection, a sensor device which is in turn connected to a remote detecting apparatus by means of energy transmission. The general system methods rely on the remote detection of an interruption or alteration of an otherwise constant pattern of energy flow which may be electrical, light, magnetic, thermal or fluidic energy.

In general, when a physical connection is employed between an energy alarm system and an object requiring protection, it is usually required that the objects have natural apertures, openings or holes, or that the objects be modified by introducing into them either apertures, appendanges or mechanisms allowing for suitable mechanical interconnection with the alarm system. This presents a problem when dealing with many types of objects such as objects of art and tools which are physically shaped so as to provide no natural means of allowing suitable mechanical attachment to an alarm system. Frequently, the physical modification of these types are objectionable, and often impractical or destructive to the purpose of the object.

A number of systems are presently in use which utilize alarm cables to protect objects against theft. Certain designs of cable attachment devices utilize adjustable mechanical loops to terminate conductive cables. With this type of structure, the device is useful only on objects having apertures within their structures through which some portion of the cable may be passed. The devices which employ mechanical loop connection of the energy conductor cables share the common defect of failing to provide a means of limiting the circumference of the loop portion to a fixed size, and of failing to provide a means of detecting the unauthorized enlargement of the protective cable loop. This type of device is totally useless in protection of objects without apertures due to the fact that a thief can simply enlarge the mechanical loop attachment mechanism and remove the cable from the object it protects without detection.

It is readily apparent from the above discussion that it would be extremely advantageous to provide a structure which alleviates the above discussed deficiencies of available structures.

SUMMARY OF THE INVENTION

With the above background in mind, it is among the primary objectives of the present invention to provide a structure for attaching the energy transmitting conductors of a remote alarm system to irregularly shaped objects which have no natural apertures in order to provide anti-theft protection. Furthermore, the device permits attachment of an alarm system to an object which requires protection in a manner which requires no alteration or modification to the structure of the object itself. Additionally, the present device is of low cost in construction and easy to install so as to provide an economical product. Finally it should be kept in mind that the present structure provides improved resistance to tampering by a thief when the device is utilized in a location exposed to such tampering.

In summary, the alarm system sensing device presented herein is adapted for use with alarm systems which monitor energy forms transmitted from remote locations. The device includes a housing having an enclosed and secured chamber therein and portions of the device are located within and without the housing. A cable containing one or more energy paths within and which physically originates within and ultimately terminates within the chamber is provided. At least one connector component device is attached to at least one end of the cable to permit the cable to be connected to and disconnected from mating connector components within the chamber. Surfaces are within the chamber and on the cable allowing the cable to couple physically therein so as to form an uninterrupted mechanical path of fixed and invariable length which may be attached to an object by encircling it. Means are provided for allowing energy to flow through the energy transmission paths within the cable during times when both ends of the cable are properly connected within the chamber thereby forming an uninterrupted mechanical path. Means are present for interrupting or altering the pattern of the flow of energy through the energy transmission paths within the cable during times when it is desirable to interrupt the uninterrupted mechanical path. Finally, means are present for accomplishing association of the device with remotely located alarm detection instruments so as to assure that alteration of energy flow patterns within the device will be instantaneously detected remotely.

With the above objects, among others, in mind reference is had to the attached drawings.

BRIEF DESCRIPTION OF THE DRAWINGS

In the drawings:

FIG. 1 is a perspective view of the device of the invention as it is used relative to a complete alarm system;

FIG. 2 is a fragmentary sectional view thereof taken along the plane of line 2—2 of FIG. 1;

DESCRIPTION OF THE PREFERRED EMBODIMENTS

Figure 3:
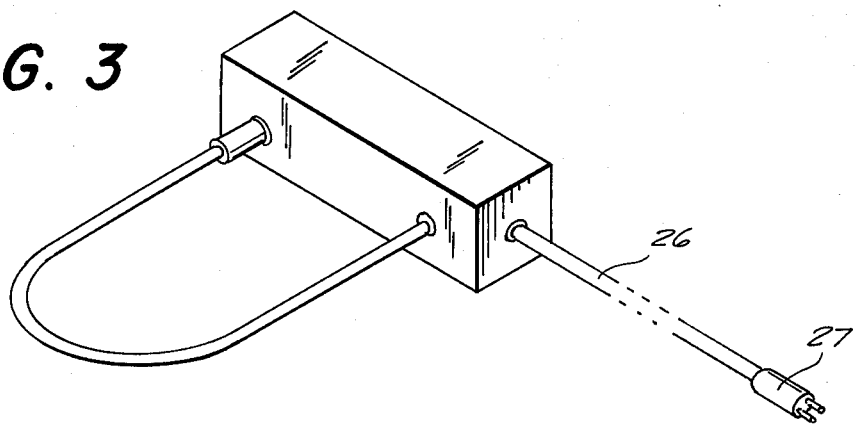
FIG. 3 is a perspective view of an alternate form of the device showing an additional connector component.

In FIGS. 1 and 2 alarm sensor device 20 is shown in interconnection with alarm system equipment 10 in a remote location therefrom. The remainder of the alarm system separate from sensor device 20 is of a typical, conventional, well-known design. Device 20 includes rectangularly shaped housing 21 which has a hollow interior so as to form chamber 22. The internal chamber is completely enclosed by housing 21 with the exception of spaced openings 23, 24 and 25 through which extend the various connectors and cables utilized in the system. While in the depicted form, housing 21 is shown in a rectangular configuration, it can be readily visualized how the housing can be altered in exterior configuration as long as it serves to form a protective closure for inner chamber 22.

An energy transmission path cable 26 is connected at one end to alarm instrument package 10 and at the other end through opening 23 to the interior of housing 21. Alarm instrument package 10 is a system device which provides a source of energy that is regulated precisely and transmitted to external energy paths in a constant pattern. Equipment within instrument package 10 monitors and measures the energy it transmits to external system components and has the capability of initiating an alarm warning signal upon the occurrence of any unusual alteration of the energy flow pattern.

As shown in FIG. 3, if desired, an appropriate connector 27 can be provided on cable 26 to facilitate removable interconnection with alarm instrument package 10. Cable 26 contains two conduits 28 and 29 with one conduit being for energy flow into device 20 and the other conduit for return energy flow to the remainder of the alarm system. Cable 26 extends through opening 23 and is mounted therein by engagement between flanged locking collar 31 and the inner adjacent surface of housing 21. Conduits 28 and 29 divide as they extend through chamber 22 with cable 28 extending through opening 24. A flanged collar 32 is mounted in opening 24 so that conduit 28 passes therethrough. Conduit 28 continues a predetermined distance beyond housing 21 and terminates in a connector element 33. Cable 29 extends within chamber 22 until it is mounted in connector receiver portion 34. Connector receiver portion 34 is mounted to the inner surface of housing 21 in alignment with opening 25. In this manner portion 34 forms a receptacle for connector 33 extending from the free end of conduit 28. Consequently, when the portion of conduit 28 outside of housing 21 is passed around an object to be protected and connector 33 is extended through opening 25 into mating engagement with receiving connector element 34 a continuous energy path is provided through conduit 28, connector 33 and conduit 29. Any alteration of the energy flow through the loop formed in this manner by interfering with the interconnection therebetween causes the alarm system to be activated. The exposed portion of conduit 28 is of a nonextendable material so that the loop formed thereby is of a constant size.

Figure 4:
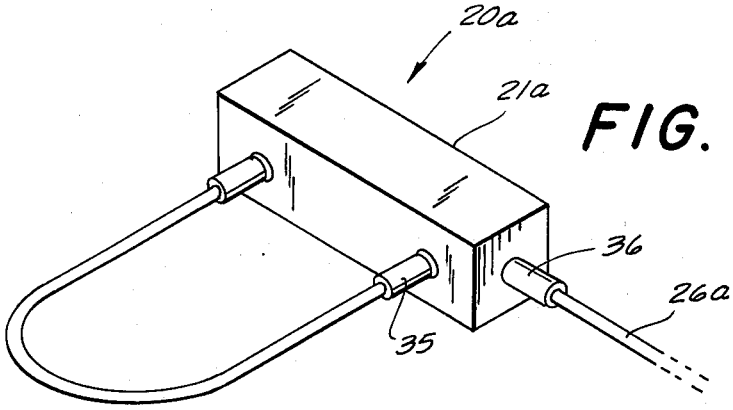
FIG. 4 is a perspective view of a further alternative form of the device showing additional numbers of connector components.

FIG. 4 shows a further embodiment in the form of device **20*a* wherein additional optional connector components are employed. Device 20*a* relates closely to device 20 and similar components are identically numbered with the addition of the subscript a applied thereto. Due to the addition of connector component 35 which inserts into and mates with an appropriate receiving connector component recessed into chamber 22 through opening 24, both ends of the exposed portion of conduit 28*a* forming the attachment loop become capable of removable interconnection. Also included in device 20*a* is an additional connector component 36 associated with the main alarm system transmission cable 26*a*. An appropriate mating receiving connector component is included within housing 21 in alignment with opening 23 so as to receive component 36 for interconnection of cable 26*a* to housing 21*a*. The type of connector arrangement employed for receiving connector 36 is similar to connector 34 in the previously discussed embodiment. Similarly, connector portions 35 and 36 are similar to connector 33** discussed in respect to the previous embodiment.

Figure 5:
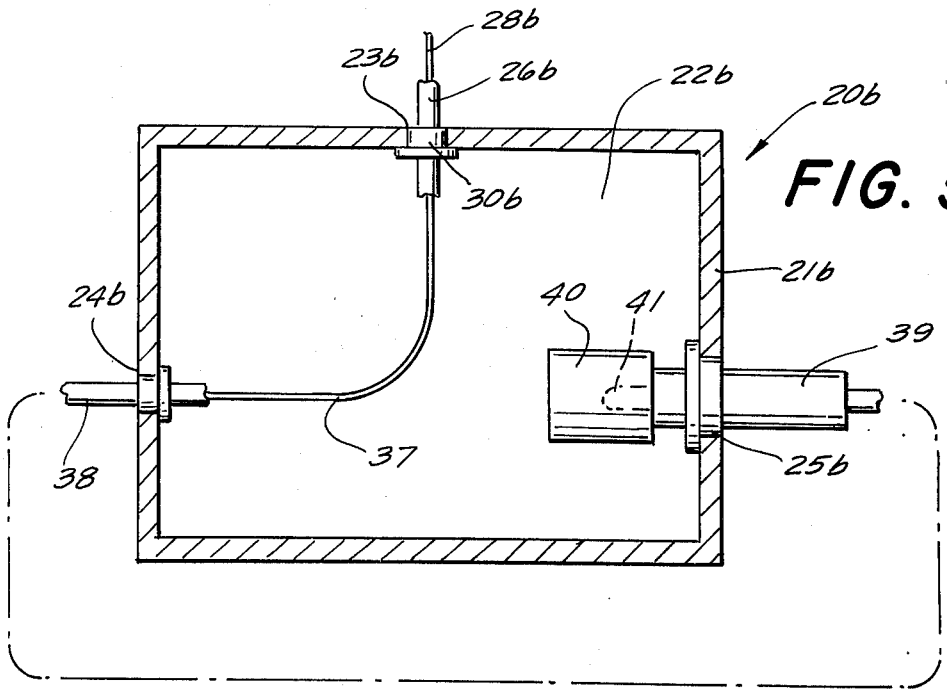
FIG. 5 is a sectional view of an alternative form of the device.

A further embodiment of the device is depicted in FIG. 5 and is identified as sensing device **20*b***. Like components have similar reference numerals as in respect to the previously discussed embodiment with the addition of the subscript *b*. Device **20*b* provides a capability of utilizing the present system in association with alarm systems supplying energy in the form of fluidic or gaseous pressure. Energy in the form of pressure is transmitted from a remote alarm instrument through cable 26*b* and more specifically through a conduit 28*b*. Conduit 28*b* runs through cable 26*b* and enters housing 21*b* through the flanged journal cylinder 30*b* mounted in opening 23*b*. The conduit continues as portion 37 to emerge at opening 24*b* as an internal component of cable 38. Thereafter, it reenters chamber 22*b* by means of connector component 39 on the opposite end of cable 38. Connector component 39 passes through opening 25*b* and interconnects with recessed receptacle connector component 40 mounted on the inner surface of housing 21 in alignment with opening 25*b*. A continuance of the same conduit which was extended from cable 26*b* is shown in phantom as portion 41 within reception component part 40. The conduit terminating in portion 41 is sealed against pressure loss by means of receiving component part 40. In this manner, a constant pressure is maintained within the overall system. A loss of pressure within the overall system such as would occur upon the disconnection of connector component 39, or a severance of either exposed cable 38 or 26*b*** would initiate a signal of alarm warning.

Figure 6:
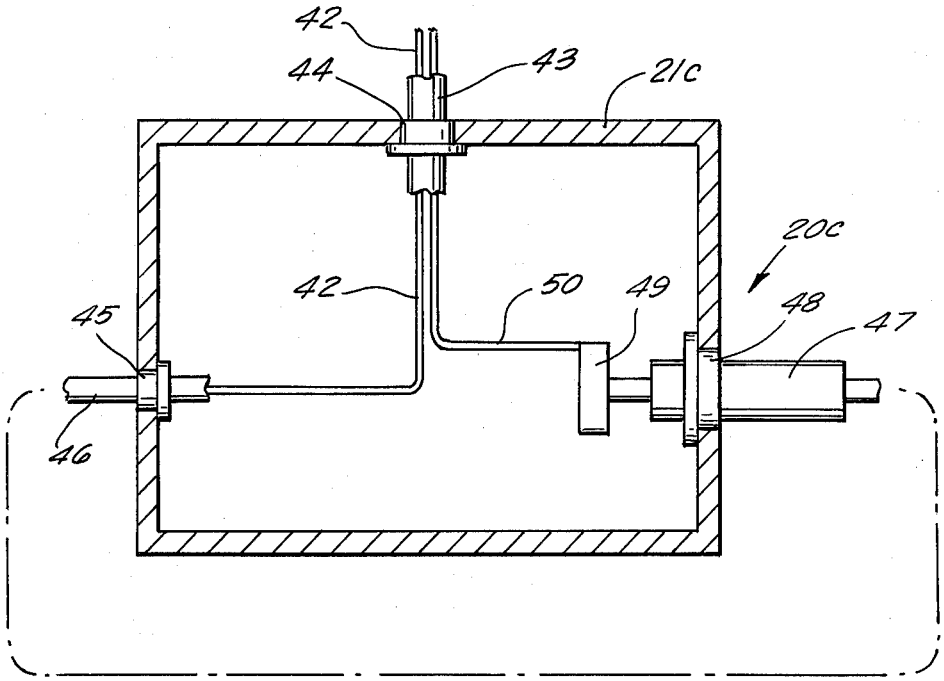
FIG. 6 is a sectional view of a further alternative form of the device.

FIG. 6 illustrates a further embodiment identified as device **20*c*. Energy transmitted from a remote alarm system instrument flows both to and from device 20*c* by means of using two paths of energy flow. In this embodiment, energy flows from the alarm system equipment through conduit 42 in cable 43 into housing 21*c* through opening 44 and continues internally of housing 21c through opening 45 to form part of an external cable component 46 forming the loop for attachment to an object. Cable 46 including conduit 42 terminates in a connector component 47 which extends through opening 48 in housing 21 into a receiving component 49. Receiving component 49 is in alignment with opening 48 so as to facilitate interconnection with connector 47. Conduit 42 in this manner is interconnected with conduit 50 extending internally of housing 21*c* from receiving connector component 49 through opening 44 and interiorly of cable 43 to return to the alarm system equipment. Disconnection of connector component 47 or a severance of either cable 43 or 46** would initiate a signal of alarm warning.

Figure 7:
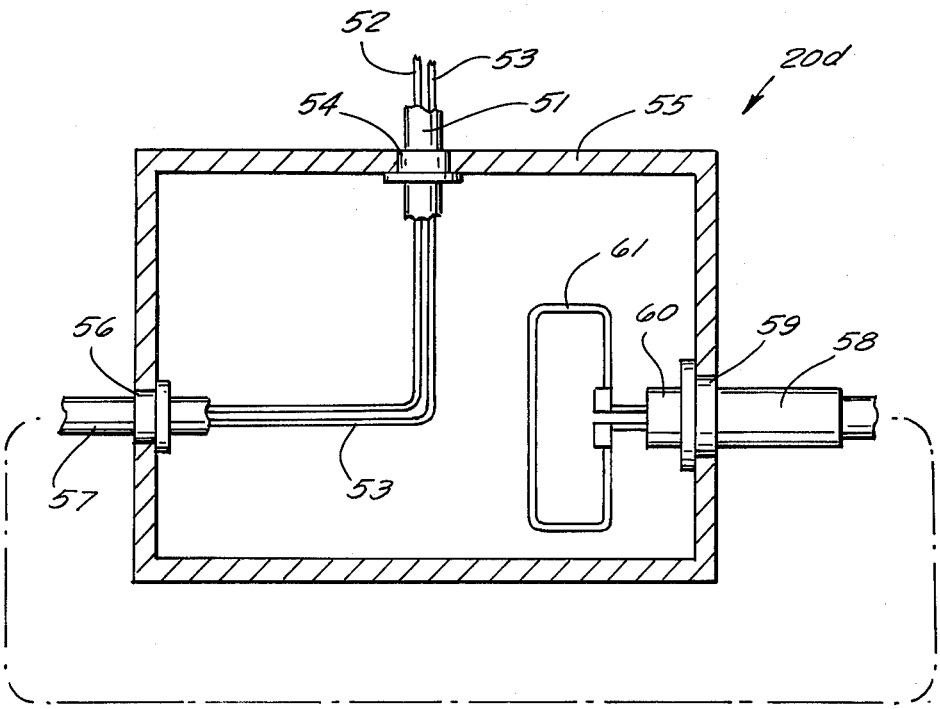
FIG. 7 is a sectional view of still a further alternative form of the device.

A further embodiment is depicted in FIG. 7 as device 20*d*. In that structure, cable 51 encloses two separate energy transmission paths. Path 52 transmits energy to the device 20*d* and path 53 provides the means to return the energy to its remote source. Energy flows from conduit or path 52 within cable 51 through opening 54 in housing 55 and extends internally of housing 55 and out through opening 56 to form an internal component of cable 57 which forms the loop for attachment to an object to be protected. Conduit 52 then extends through connector 58 which is passed through opening 59 in the housing for interconnection with a receiving connector component 60 to complete the loop. Conduit 52 is thus interconnected with an internal component 61 which passes back into receiving connector 60 to become continuous with return energy path 53. The return energy path then extends back through cable 57 through opening 56 and thereafter through the interior of housing 55 to exit through opening 54 and into cable 51 for return to the energy source. Again, as previously discussed in regard to other embodiments, disconnection of connector component 58 or a severance of any part of exposed cables 51 or 57 would initiate a signal of alarm warning.

Operation of the various embodiments is quite similar and for purposes of illustration, description of the operating steps of use of the devices can be related in respect to the embodiments of FIGS. 1–3. A condition of normal energy flow within the overall system is established by the act of inserting the connector component 33 into the mating receiving connector component 34 located within chamber 22. Having once established a condition of normal energy flow within the overall system, an alarm signal will be initiated by any future interruption or alteration of the pattern of energy flow such as would occur upon subsequent separation of connector component 33 from the internal connector component 34 which are interconnected through opening 25 in housing 21, or as a result of the severance of any portion of cable 28 or 30.

An uninterrupted mechanical path is created which is equal in length to the combined total of the physical measurements of the distance along housing 21 between openings 25 and 24, the physical length of the cable loop 28 located externally of housing 21, and the physical length of the exposed portion of the connector component 33. By utilizing the uninterrupted, closed mechanical loop thus formed, the device provides the capability of attachment to the structure of an object which requires protection. Attachment of device 20 to an object is accomplished by encircling a portion of the object's structure within the previously described closed mechanical cable loop.

Figure 8:
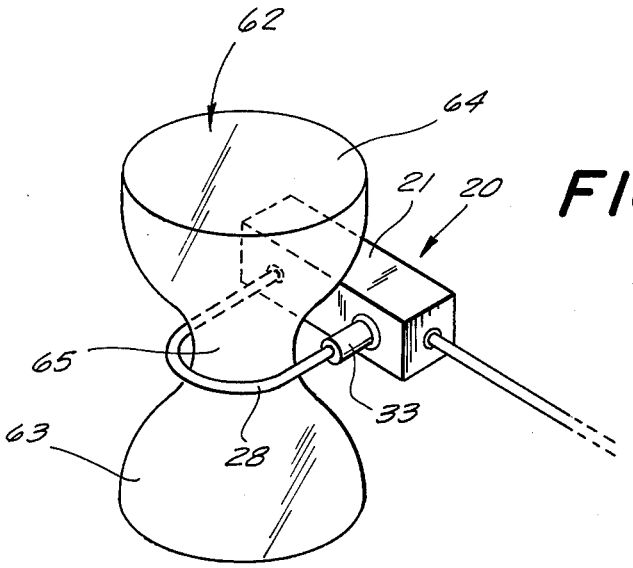
FIG. 8 is a perspective view of the device in engagement with an object being protected.

FIG. 8 depicts an object 62 which has a structural shape commonly called an hourglass figure. It can be seen that object 62 has end portions 63 and 64 which are larger than the centrally located midsection 65 of the object. Device 20 is directly attached to object 62 for protective purposes. Device 20 is designed for use with object 62 so that the absolute measurement of the circumference of the closed mechanical path as formed by cable 28, connector component 33 and a portion of housing 21 is of smaller size than the extremities of object 62. In this manner, device 20 can not be slipped off of object 62 which it serves to protect. Attachment of device 20 is achieved in the manner described above whereby exposed cable portion 28 is looped around midportion 65 of object 62 and connector 33 is interconnected with the receiving component within housing 21. Energy then flows through this system so that interruption or alteration of the energy path causes a resultant alarm signal.

Figure 9:
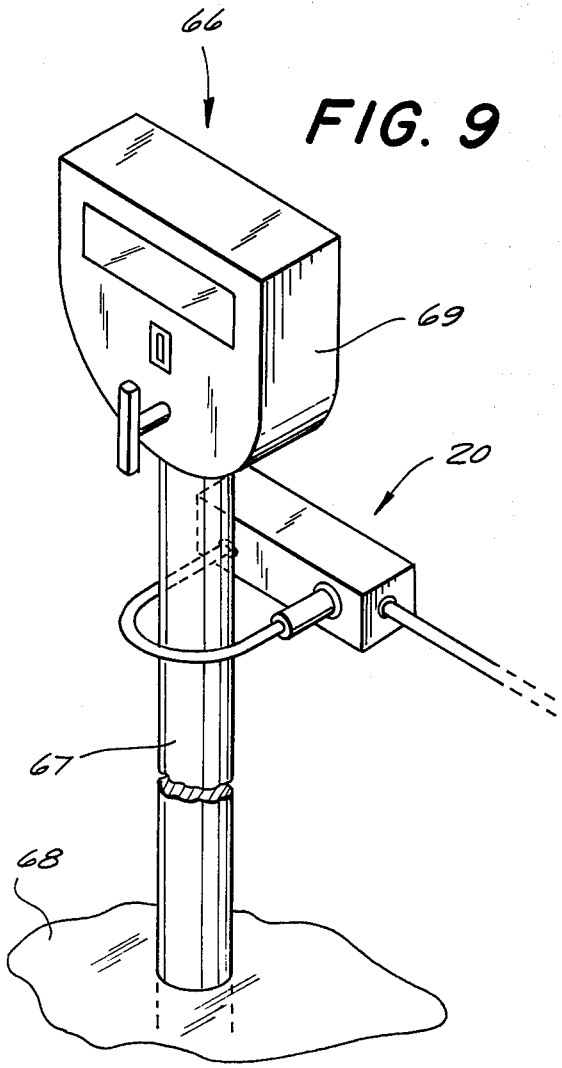
FIG. 9 is a perspective view of the device in engagement with a different type of object being protected.

Another type of object to which device 20 can be applied is depicted in FIG. 9. Device 20 is shown securely attached to a parking meter object 66. The effect of a secure attachment of device 20 to object 66 is possible due to the fact that the meter base 67 is generally firmly embedded in concrete 68. The upper portion 69 of the meter structure is larger in size than the circumference of the closed mechanical loop mechanism of device 20, thereby preventing device 20 from being slipped off meter 66. Normally, device 20 encircles and secures the specific object which it serves to protect. However, if the remote alarm system instrument which is attached to cable 26 can itself be securely enclosed and securely attached to, or housed within an object which requires protection, then protection against unauthorized movement of the object can be achieved by utilizing device 20 to accomplish secure attachment to a nearby immovable object, for example meter 66.

Several other modifications bear consideration. For example, in the embodiment of FIG. 7, internal component 61 is depicted as a conductor path which functions as a continuation of other energy paths described. It is possible to substitute in place of conduit 61, an energy field reflector component which would indirectly provide the required feed-back of energy to the system transmission paths.

Figure 10:
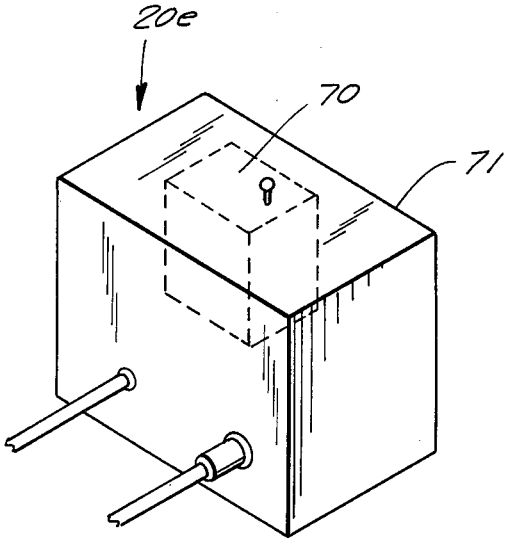
FIG. 10 is a perspective view of another alternative form of the device.

Secondly, all of the described embodiments show the requirements of using an energy transmission path in the form of a cable which interconnects the sensing device with a remote alarm instrument by direct physical methods. The use of radio transmission techniques are well known and understood in the field of alarm system security apparatus. Therefore, it can be readily envisioned, as depicted in FIG. 10, how a miniature radio transmission device 70 would be installed within housing 71 as alternative embodiment 20*e*. In this manner, the need for direct system interconnection is eliminated, thus eliminating the cable attachment between the device and the remainder of the alarm system.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. An alarm system sensing device attachment for use with alarm systems instruments and detector systems which monitor the stability of energy forms transmitted between remote locations comprising:

a housing having within a secure enclosed chamber, said chamber containing a number of connecting devices protectively recessed within and extending to and through the outer surface of the housing;

a flexible cable component containing within one or more conductive energy paths, said cable originating from within the interior of the protective housing and thereafter passing to a physical location outside of said housing, thereafter extending without interruption for a certain distance outside of the housing and ultimately terminating within said same housing, the final termination being accomplished by means of suitable recessed connector component devices;

the internal conductive energy transmission paths being completely concealed and protectively enclosed by the housing and the body of the connecting device components to provide the physical condition of self-protection and freedom from tampering and so as to establish a condition whereby the partial physical separation of the joined connector device components causes an interruption of the energy paths within prior to the time when a further physical connector component separation actually exposes to view those elements which comprise portions of said energy paths;

the connection devices being capable of simultaneously providing both the junction of energy transmission paths, and mechanical interconnections of adequate strength to resist accidental separation of the associated mating connector components;

said housing, said connecting devices, and said external cable component, providing a physical design wherein the housing itself and the external cable join together through the connecting devices so as to form in concernt a closed loop of invariable length of circumference thereby allowing the loop so established to encircle and thereby become securely attached to the narrow portion of an irregularly shaped object without the necessity of having any portion of the attachment device pass through openings or other apertures in the object itself;

means on the housing for communication with alarm system detection instruments located remotely;

the connector components, conduits, cables, and conductive paths being interconnected with the housing so that energy supplied to the device will establish pathways within the external cable portion and through portions of the interior area of the housing;

means permitting the device to be made compatible with detection instruments of desired form of transmitted energy; and the several mechanical and energy conductive components of the device being interrelated so as to assure that the attempted enlargement of the established fixed circumference of the closed attachment loop will result in the interruption of alteration of the normal pattern of energy preestablished within said loop components thereby providing a means whereby the physical act of said loop enlargement may be remotely detected by instruments.

2. The invention in accordance with claim 1, wherein the means on the housing for communication with an alarm system detection instrument located remotely includes a separate suitable recessed connector device at a point on the surface of the housing separate from the described points of connection of the external cable component for the purpose of providing a secure method of allowing interconnection between the device and alarm system detection equipment requiring the use of physical interconnection of energy paths in the form of conductive transmission lines, the conductors, conduits, connectors and transmission lines permitting the device to be made compatible with detection instruments of desired form of transmitted energy.

3. The invention in accordance with claim 1, wherein the means on the housing for communication with an alarm system detection instrument located remotely includes a miniature energy radiating apparatus and a source of stored energy internally installed and interconnected within the housing to permit the use of the device with detection instruments which utilize energy transmission in the form of radiated energy.

* * * * *